United States Patent [19]

Fuerstman

[11] Patent Number: 4,657,807

[45] Date of Patent: Apr. 14, 1987

[54] BRIGHT METALIZED FABRIC AND METHOD OF PRODUCING SUCH A FABRIC

[76] Inventor: Myron M. Fuerstman, 21 Suburban Ave., Pelham, N.Y. 10803

[21] Appl. No.: 885,383

[22] Filed: Jul. 14, 1986

Related U.S. Application Data

[63] Continuation of Ser. No. 627,490, Jul. 5, 1984, abandoned, which is a continuation-in-part of Ser. No. 340,539, Jan. 19, 1982, abandoned.

[51] Int. Cl.[4] ..... B32B 7/00; B32B 15/00

[52] U.S. Cl. ..... 428/263; 427/250; 427/316; 427/404; 427/407.1; 427/412; 428/265; 428/285; 428/286

[58] Field of Search ..... 427/294, 299, 296, 316, 427/322, 324, 250, 360, 366, 367, 350, 383.1, 389.9, 404, 407.1, 412; 428/263, 265, 285, 286, 379, 392, 393, 394, 395, 474.4, 425.8, 480, 458, 463

[56] References Cited

U.S. PATENT DOCUMENTS

| | | | |
|---|---|---|---|
| 3,086,879 | 4/1963 | Lassiter | 427/360 |
| 3,290,203 | 12/1966 | Antonson et al. | 161/4 |
| 3,463,659 | 8/1969 | Dragoon et al. | 427/296 |
| 3,914,471 | 10/1975 | Cobb et al. | 427/316 |
| 4,052,521 | 10/1977 | Ferran | 427/316 |
| 4,095,013 | 6/1978 | Burger . | |
| 4,226,910 | 10/1980 | Dohlen et al. | 428/336 |
| 4,390,588 | 6/1983 | Ebneth et al. | 427/412 |
| 4,508,776 | 4/1985 | Smith | 427/250 |

FOREIGN PATENT DOCUMENTS

| | | | |
|---|---|---|---|
| 40-1677 | 1/1965 | Japan | 427/316 |
| 479796 | 11/1975 | U.S.S.R. | 427/316 |

OTHER PUBLICATIONS

Goodman, "Metalizing—What it is, What it Does—It's Dramatic, Efficient" Paper, Film and Foil Converter, Feb. 1958, pp. 26–29.

"Vacuum Coating": *Metals Handbook,* 8th Ed. vol. 2, pp. 516–528, American Society for Metals, 1964.

Dri-Print Foils, Beatrice Chemical Co.—advertising sheets (3).

*Primary Examiner*—Sadie L. Childs

*Attorney, Agent, or Firm*—David R. Treacy

[57] ABSTRACT

A bright-finish metal-coated fabric having a metal layer directly deposited on the fabric. A fabric, selected to be capable of flattening or polishing under heat and pressure, is pressed against a heated surface and is then vacuum metalized. In a preferred embodiment, a thermoplastic fabric is flattened against a hot roll in a calender press under high pressure, and aluminum is then vapor-deposited.

30 Claims, No Drawings

BRIGHT METALIZED FABRIC AND METHOD OF PRODUCING SUCH A FABRIC

This is a continuation of application Ser. No. 627,490, filed July 5, 1984, now abandoned which in turn is a continuation-in-part of application Ser. No. 340,539, filed on Jan. 19, 1982, abandoned.

BACKGROUND OF THE INVENTION

1. Field of the Invention

The invention relates to fabrics having a bright-finish metallic appearance, and more particularly to thermoplastic fabrics which are desired to have a brilliant metallic reflectance either for aesthetic reasons or for heat reflecting.

For thousands of years highly reflecting fabrics have been prized for special applications, even to the point where precious metals such as gold were incorporated in the weave. Those who could not afford such extravagance would get satin or, in modern times, synthetic fabrics which were specially treated to provide a glossy appearance. Where heat reflectance is a major consideration, aluminized fabrics have been made at great expense for protective clothing such as used for firemen or workers around furnaces, but these were not suitable for ordinary use.

In addition to fabrics used for clothing, the great interest in energy conservation over the last few years has sparked development of methods for reducing winter heat loss and summer heat gain through windows. Commercial buildings often have heat-reflecting films applied to windows, but these have not found wide application in private homes because of the nuisance in having them applied, the loss in visible light transmission which makes a slightly cloudy day seem gloomy, and the fact that the windows can have a mirror-like appearance which is always there. One solution to this dilemma is the reflecting window shade, which has a metalized film on an outside layer, and a fabric inside surface for appearance and perhaps also for insulation. However, these multi-layer shades are bulky, and tend not to hang flat because of the different characteristics of the film and the fabric.

2. Description of the Prior Art

Vapor deposition of metal onto a transparent film to produce an article suitable for gluing onto a window has been known at least since U.S. Pat. No. 3,290,203. Although the products taught therein successfully reduced heat loss, and could be tinted to provide a pleasing appearance, they could only be permanently installed (the film could be removed but not re-applied). Thus these products could not be used as a window shade, which could be rolled up as desired. More recently, metalized polyester film shades have become commercially available.

Although metalizing of film has been practiced successfully for many years, the problems involved in metalizing other materials have been solved only more slowly, and often less successfully, as pointed out in the article, "Metalizing—What it is, What it does—It's Dramatic, Efficient", published in "Paper, Film and Foil Converter", February, 1958, pp 26–29.

Up to now, the most successful commercial process for making glossy metalized fabrics has been the transfer process, by which a metal film is actually glued to fabric. This process involves preparing a transfer film by applying a "release agent" to a base or carrier film such as a polyester film. A thin film of the desired metal is then vapor-deposited on the release agent. A thin layer of adhesive is then applied over the metal layer. Another adhesive layer is applied to the fabric, and the metal layer is then transferred to the fabric by placing the adhesive-coated metal side of the film in contact with the adhesive-coated fabric, and passing them around a heated drum while holding the film against the fabric, for example by an endless blanket pulled taut around the outside of the sandwich. Although successful, this process is quite expensive, because of the cost of the carrier film, application of its multiple layers in successively different machines, and then finally the transfer process; in 1981 this procedure added more than $3.00 peryard to the cost of a fabric.

Attempts to apply metal layers to fabric directly did not produce the desired glossy appearance. Experiments with many different fabrics, including "long float" fabrics which had a glossier than average appearance before coating because of the special weave, as well as "bright yarn" fabrics of different chemical compositions, have so far been unsuccessful in producing a really high shine.

SUMMARY OF THE INVENTION

To overcome the disadvantages of the prior art, it is an object of the invention to provide a method of producing a glossy metalized fabric which does not require special weaving or knitting of the fabric.

Another object of the invention is to provide a bright-finish metalized fabric in which the metal is applied directly to the cloth.

Yet another object of the invention is to provide a method by which a sculptured metalized appearance may be obtained without any additional processing.

According to a first aspect of the invention, I have discovered that a bright-metallic-finish fabric is produced by selecting a thermoplastic fabric, flattening a surface of the fabric by pressing it against a smooth heated surface, and then depositing a reflective metal material on the flattened surface. More particularly, as used herein, flattening means a process step in which a fabric is compressed against a surface under such pressure and temperature conditions that the apparent thickness and porosity (permeability to air) of the fabric is reduced.

In a preferred embodiment of this aspect of the invention, flattening is performed by passing the thermoplastic fabric between two rolls, one of which has a polished surface and is heated to a temperature sufficient at least slightly to soften the surface of the fabric; in particular, the flattening step involves passing the fabric through the nip of a calendering press under high pressure. After flattening, the fabric is placed in a vacuum chamber, and a thin coating of a desired metal is vapor-deposited on at least the surface which contacted the heated polished roll. To produce a high reflectance silvery surface inexpensively, deposition of an aluminum layer having a resistance of less than one ohm per square is preferred.

In order to improve the resistance of the bright finish to laundry or dry-cleaning effects, after flattening and metalizing, a clear polymer top coating may be applied. Polyurethane materials have been found particularly suitable for this purpose. While applicant is familiar with the use of such coatings on foil materials, to the best of his knowledge transparent colored coatings have not been previously applied to fabrics. Because the bright finish of this invention is useful in items such as sleeping bags where the surface is subject to considerable friction against a user or user's clothing, the abrasion resistance gained is also quite valuable.

Further, a gold or other color desirable for high fashion may be obtained, with no significant loss of brightness, by incorporating a transparent dyestuff in a urethane material which is applied using a solvent system and is then cured. By selecting a "neutral" dyestuff, and selected solids contents for the system, the resultant product is not attacked significantly by chlorinated solvents such as perchlorethylene used in drycleaning.

According to a further preferred method embodying the invention, the heated roll has a mirror-like chromed surface, and may also be engraved with fine lines arranged at an acute angle, prefereably approximately 20°,from the direction of the filling or horizontal of the fabric; and if the fabric is composed of twisted yarns, the engraved lines are in the direction of yarn twist.

According to a second aspect of the invention, a high-metallic glossy patterned fabric is produced by selecting a thermoplastic fabric; pattern-flattening a surface of the fabric by passing the fabric between two rolls of a calendering press under high pressure, one of these rolls being heated and having a mirror-like surface in which a decorative pattern is engraved or recesed, such that the engraved or recessed areas flatten the fabric less than the non-recessed areas, or not at all; and then depositing a reflective metal material on the surface which contacted the heated and patterned roll, so as to produce a fabric having a high gloss pattern against a background of lesser or little or no gloss, without any additional processing steps.

According to yet a third aspect of the invention, a bright-metallic-finish fabric may be produced by selecting a fabric comprising thermoplastic yarns, polishing a surface of the fabric by pressing it against a heated surface with relative motion between the fabric surface and the heated surface, and then depositing a reflective metal material on the polished surface. In a preferred embodiment of this aspect of the invention, the fabric is polished by passing it around at least one roll such as a heated roll or drying can, the roll being rotated with a surface speed faster or slower than the fabric speed or in the reverse direction.

By use of the inventive method, a fabric is produced which has an exceptionally high metallic gloss, is far denser (less porous) than the untreated fabric, and yet has a good "hand" and retains its appearance after ordinary laundering or dry cleaning. The flattening and depositing steps (with aluminum) would typically add only $0.15 to $1.40 per yard to the cost of the fabric, at 1981 prices, depending on the fabric type and length processed.

DESCRIPTION OF THE PREFERRED EMBODIMENTS

According to a first preferred embodiment of the invention according to its first aspect, a fabric is selected consisting of thermoplastic twisted yarns such as a polyester, having a moderately dense weave. The fabric is then flattened by calendering it in a press having a chromed, polished roll heated to a temperature of at least approximately 385° F. (197° C.), and preferably to a temperature of approximattely 425° F. (218° C.). Opposite the heated roll is an unheated second roll, such as a paper roll; that is, one formed of compressed discs of heat-resistant paper and having a very smooth surface. The rolls are pressed together with a force of at least approximately 2½ tons per foot of roll length (150,000 newtons per meter), and preferably with a force of approximately 10 tons per foot (300,000 newtons per meter). The fabric is passed through the nip of the press at a speed of approximately 15 yards per minute (14 meters per minute).

After calendering, the fabric is wound on a roll. The roll is then placed into a vacuum chamber, and a high vacuum is pulled to out-gas the fabric. The fabric is then passed through a space in the chamber to a take-up roll, as it does so a layer of aluminum being vapor-deposited on at least the surface of the fabric which had contacted the chromed, heated roll. For maximum reflectance if aluminum is deposited, a thickness of at least 500 to 800 Å is applied. Upon removal from the chamber, the fabric will be observed to have a high silver gloss on that surface.

According to a second preferred embodiment of the invention, a fabric selected as above is flattened by calendering at the same temperature and pressure; however, instead of a smooth polished chromed roll, the steel roll is engraved with a series of fine lines, between 150 and 500 lines per inch (6 to 20 lines per mm), generally at a 20° angle to the filling or horizontal of the fabric in the direction of the twist of the yarn.

In a further embodiment of the second aspect of the invention, the steel roll of a calendering press is engraved or otherwise provided with a decorative or other relief pattern, such that the recessed areas of the roll will provide less flattening. This roll is then heated, for example as described above, and a thermoplastic fabric is calendered under a high pressure determined to give the desired effect. After calendering, the fabric is coated with a vapor-deposited layer of metal, which will exhibit a high shine in the more heavily flattened areas but lesser gloss in the portions corresponding to the recessed areas of the roll. One should then expect a visual effect, after metalizing, somewhat like a damask.

In yet another embodiment, of the third aspect of the invention, a fabric which includes thermoplastic yarns may have a surface polished by pressing it against a heated surface which undergoes relative motion with respect to the fabric. One or two or more passes around drying cans, appropriately heated, may so polish and flatten the surface contacting the can that metalizing as described under the other embodiments will provide a high gloss. The cans may be stationary, or rotated in either direction, so long as there is relative motion.

EXAMPLE

A 100% polyester fabric, woven with 70 denier warp and 150 denier filling, was selected for processing according to the first preferred method. The fabric was calendered using a polished, chromed steel roll heated to approximately 425° F. (218° C.). The polished steel first, or top, roll was approximately 14"(35½) in diameter, while the bottom or second paper roll was 36" (8½) inches in nominal diameter. The pressure on the calender was set at approximately 40 tons ($1.2\times10^6$ newtons), which resulted in a force per unit length of about 10 tons per foot (300,000 newtons per meter). The calender was operated at about 15 yards (13.6 meters) per minute. After calendering, a portion of the fabric was saved for testing, while the balance was vapor-deposited with aluminum, the coatig being thick enough to achieve a resistance of less than one ohm per square. The resulting fabric had a high, attractive silvery gloss on the surface which had contacted the steel roll, and a dull silver appearance on the reverse side.

A sample of the fabric, which was neither calendered nor metalized, was measured and a thickness reading of 0.004 to 0.0044 inches, by micrometer, was obtained. The calendered, un-metalized portion was similarly measured, and read 0.0028 to 0.0033 inches, while the metalized portion read 0.003 to 0.0035 inches. These readings should be considered only exemplary, of course, and may reflect significant measurement imperfection; nonetheless, they are believed to show significant flattening related to the high shine obtained. The differences between the calendered portion, and that fully metalized, is believed to be due to experimental error and random variation between different fabric areas, rather than to the metalizing.

When viewed under a fluorescent light at an angle, through a 7-power loupe, the uncalendered, unmetalized sample showed reflection from highlights on the fill yarns, but almost none from the warp, when the fabric was turned so that the filling ran from the observer toward the light. Turned the same way, the calendered, unmetalized portion showed highlight reflections from both the filling and the warp. The metalized surface, on the side contacted by the heated roll, had a brilliant silver reflection from both filling and warp when viewed in the same light at the same angle.

The difference in fabric permeability to airflow was also tested, following the method of ASTM D-737. The control sample (neither calendered nor metalized) showed an air flow of 221.7 cfm/ft$^2$, with a range of 207.0 to 232.0; while the calendered and metalized fabric showed an air flow of only 43.0 cfm/ft$^2$, with a range of 41.0 to 51.0. These results demonstrate a great reduction of porosity, by use of the invention.

To determine the effectiveness of the inventive fabric as a thermal shade or curtain, the reduction in thermal transmittance when compared with a bare window was measured by the Guarded Test Window Method, using a single light window, with the fabric sealed to the test window frame on all edges and the metalized surface facing the apparatus, in a manner to give the highest possible reading in terms of R value. With outside glass temperatures approximately the same, and inside ambient temperatures also about the same but approximately 45° F. (25° C.) lower, the fabric-covered window showed a 64.6% reduction in heat loss compared with a bare window.

Additionally, some of the same metalized fabric was tested for shrinkage and appearance after machine laundering according to AATCC 135 B @105° F. (about 40° C.). The tested samples fell well within recommended shrinkage tolerances and had a retention of high metallic shine rated "good to excellent" per procedure AATCC 124 and visual examination; this retention of metallic was stated to be the best ever observed by the testing company.

TOP COATING

In an attempt to provide a gold color to a fabric, while metalizing with inexpensive aluminum, a length of polyester single-knit fabric was calendered under heat and pressure, and then metalized with aluminum to produce a high brilliance metalized surface. A small amount of Neoza Pon yellow 141 dye, from BASF Wyandotte Corp., was dissolved in isopropanol, and this dye was added to Solucote 385, a polymerizable urethane coating material obtainable from Soluol Chemical Co., Inc. of West Warwick, R.I. This was diluted to a solids content of approximately 36%, with isopropanol. The system had a viscosity of about 500 centipoise. The fabric was then rotogravure printed with this solution, and then heat cured for approximately 2 minutes at 135° C. (275° F.). A brilliant gold color was achieved.

A first portion of the gold fabric was cold-water washed, and showed no loss of brilliance or gold color. A second portion was dry cleaned by a commercial dry cleaner using a perchlorethylene solution. The dry cleaning process removed the gold color, although at least some of the polyurethane coating remained on the fabric.

I have finally obtained a successful gold color by selecting Lavaderm yellow, a true solution of an anionic metal complex dye obtainable from Mobay Chemical Corp. This was diluted in alcohol, and added to Soluol No. 10214A, a urethane similar to Solucote 385, having approximately 43% solids. The resulting system had a viscosity of approximately 6000 centipoise. This was applied as a top coating onto another length of high brilliance fabric used for the unsuccessful attempts described above, using a Meyer bar coating rod and curing in a laboratory oven at 135° C. (275° F.) for approximately 2 minutes. Again a brilliant gold color was achieved. A portion of the length was coldwater washed without effect on appearance. A second portion was dry cleaned as before, but in this case the brilliant gold was not affected. This coating thus provides a desired color change, as well as protecting the metal coating from abrasion and reducing any edge ravel which might affect the fabric.

This system, or one like it, could effectively be applied to single-knit polyester fabrics on a production basis by knife-over-roller coating. If a woven polyester is to be similarly coated, because of its lower stretch either knife-over-roller or common coating techniques such as floating knife should be equally effective.

ALTERNATIVE EMBODIMENTS

It will be clear to those of ordinary skill in the fabric converting art, upon reading the above descriptions, that many other fabrics and process variations may be used to provide a bright metallic appearing fabric by the inventive method. Many different fabrics are believed suitable for use, including "long float" fabrics, which have a greater sheen as woven; and knitted or any other yarn-base fabric. Other thermoplastic yarns, such as nylon, acrylic copolymer, polyacrylonitrile, modacrylic, vinyl, tri-acetate and the like can be used, although the optimum temperature and pressure may differ from that used for the polyester sample described above. Composite yarns having a mixture of thermoplastic and cellulosic or other fibers or filaments may also be treated by this method, so long as a significant flattening or polishing can be achieved; if technologies not known to applicant can produce fabrics from randomly oriented fibers, it is believed that the inventive method would be efficacious. Relatively open or sheer fabrics would, of course, have a slightly more dense appearance, but could also be flattened and metalized.

Other fabrics which may be or become known, such as cotton or linen, perhaps having resin coatings, which are especially desirable for clothing, may also be given a glossy metallic look by the inventive method, by pressing or compressing still harder, with greater or less heat.

Depending upon the construction and weight of the fabric, temperatures at least as low as 385° (197° C.) and as high as 450° F. (232° C.) may be preferred for polyesters, and the pressure of the calender may be altered at least over the range of 2½ tons to 13 tons per foot (75,000 to 420,000 newtons per meter). Other materials, which are less heat resistant than polyesters, may be flattened sufficiently at temperatures as low as approximately 250° F. (120° C.).

Experimentation, as is well known, may be required to determine the temperature and pressure and processing speed which will give a desirably high metallic shine after metalization. Processing speed or quality may be improved by use of a calender whose second, unheated roll is not a paper roll. An elastomer-covered steel roll, having a layer of elastomer up to, for example, approximately ⅝" (16 mm) thick, and internally water cooled to prevent overheating of the elastomer during prolonged operation, has been suggested as permitting speeds up to 40 yards (36 meters) per minute. Another calender arrangement may use a nylon-covered second roll, cooled by contact with a chilled third roll.

Rather than a calender, flattening may be possible by pressing the fabric against a heated roller by a taut blanket, such as is used in transfer printing; alternatively, such a roller may be rotated at a different speed than the fabric speed to provide a polishing effect. Similarly, one or more cans in a series of drying cans can be rotated at varying speeds or directions for polishing. Yet another alternative falling within the spirit of the invention is a combination of flattening and polishing prior to deposition with metal; for this, a friction calender may have fabric passed through a first nip between two rolls, around the second of these rolls and through a second nip between the second roll and a heated roll made of polished steel and rotating with a surface speed typically 1½ to 2 times the fabric speed.

Aluminum will usually be the choice of metal to be vapor-deposited, because of its low cost and the wide experience in applying it. However, where special appearance or corrosion resistance are paramount, any of many other metals or alloys may be applied, such as gold, silver, nickel, copper, chromium, or other metals or alloys such as those described in the article "Vacuum Coating" in *Metals Handbook,* 8th ed., vol. 2, pp. 516–528, American Society for Metals, 1964 (hereby incorporated by reference). Different deposition procedures, such as sputtering, may enable coating with materials which prove difficult for use with vapor desposition. After metalizing, a top coating of types other than the organic solvent, polyurethane family described above, may be helpful to reduce edge ravelling of the fabric, prevent abrasion of the metal coating, or allow coloration. For example, a clear polyurethane coating has been applied using an aqueous carrier. High solids content has been found preferable so far, but solids content of at least 35% appear to be effective. Other coating systems, such as acrylics, are also within the spirit and scope of the invention. Alternatively, although there will be less brightness, if a brightly colored fabric is selected, a very thin metallic coating, having a substantial transmission of visible light, maybe applied by the inventive method, to provide a colored metallic appearance.

As described above, it will be clear that the inventive method may be used to produce a variety of novel fabrics having improved aesthetic appearance, at little more than the cost of unmetalized fabric. As measured by the appended claims, according to the invention fabrics suitable for heat transfer reduction can now be readily mass-produced, so as to enable economic reduction of heating or air-conditioning bills for residences. A low cost cloth for reflective clothing useful in tropical or desert areas, or to reduce radiative loss of body heat in frigid ambients, is now provided.

I claim:

1. A method of producing a fabric having a bright-finish metallic appearance, comprising:

(a) providing a fabric comprising fibers which can be flattened by heat or pressure, (b) flattening or polishing a surface of said fabric by pressing it against a smooth heated surface, and (c) then depositing a reflective metal material directly onto the flattened or polished surface.

2. A method as claimed in claim 1, characterized in that said depositing step is a vacuum metalizing step.

3. A method as claimed in claim 2, characterized in that said heated surface is a polished metal cylinder.

4. A method as claimed in claim 3, characterized by providing relative motion between said fabric and the heated surface against which it is pressed.

5. A method of producing a thermoplastic fabric having a bright-finish metallic appearance, comprising:

(a) providing a fabric comprising yarns including a thermoplastic material, (b) heating a hard roll of a calendering press to a temperature sufficient at least slightly to soften a surface of the fabric upon contact with the roll, (c) calendering said fabric under high pressure between said heated hard roll and a second roll of the press, and then (d) depositing a metal layer on the surface of the fabric contacted by said heated roll.

6. A method as claimed in claim 5, characterized in that the depositing step is a vacuum metalizing step.

7. A method as claimed in claim 5, characterized in that the heated hard roll is a steel roll having a polished surface.

8. A method as claimed in claim 7, characterized in that said heated hard roll has a mirror-like chromed surface.

9. A method as claimed in claim 7, characterized in that said heated hard roll has a multiplicity of fine lines engraved in its surface, arranged at an acute angle with the horizontal of the fabric.

10. A method as claimed in claim 9, characterized in that said fabric is selected to be a woven fabric having twisted yarns, said acute angle is approximately 20°, and the lines in said heated hard roll are arranged in the direction of twist of the yarns.

11. A method as claimed in claim 5, characterized in that said heated roll is a metallic roll, and said secondroll is a hard roll having a surface of non-metallic material.

12. A method as claimed in claim 5, characterized in that said heated roll is a metallic roll, and said second roll is a metallic roll having a surface of a more resilient material.

13. A method as claimed in claim 12, characterized in that said second roll has a cooled surface.

14. A method of producing a fabric having a bright-finish metallic appearance, comprising:

(a) providing a fabric comprising thermoplastic material, (b) selecting a calendering press having a hard metal first roll and a second roll, (c) heating said first roll to a temperature of at least approximately 250° F., (d) then calendering said fabric between said rolls at a pressure of at least approximately 2½ tons per foot, and then (e) depositing a reflective metal layer at least on the fabric surface contacted by the first roll.

15. A method as claimed in claim 14, characterized in that said first roll has a relief pattern formed by raised polished areas and intervening recessed areas, for producing a patterned fabric.

16. A method as claimed in claim 14, characterized in that said press is a friction calender.

17. A method as claimed in claim 14, characterized in that said fabric is selected to consist essentially of polyester yarns, and that the first roll is heated to a temperature between approximately 385° F. and 450° F.

18. A method as claimed in claim 17, characterized in that the calendering pressure is between approximately 5 and 13 tons per foot.

19. A method as claimed in claim 18, characterized in that said temperature is approximately 425° F. and said pressure is approximately 10 tons per foot.

20. A metallic coated fabric, having a glossy shine, produced by the method of claim 1.

21. A method as claimed in claim 5, comprising the step of subsequently applying a transparent top coating over the metal layer.

22. A method as claimed in claim 21, characterized in that said top coating contains a transparent dye.

23. A method as claimed in claim 21, characterized in that said top coating comprises a polyurethane material.

24. A method as claimed in claim 23, characterized in that the polyurethane material is applied in a system comprising at least 35% solids.

25. A metallic coated fabric, having a colored glossy shine, produced by the method of claim 22.

26. A metallic coated fabric, having a glossy shine, produced by the method of claim 5.

27. A metallic coated fabric, having a glossy shine, produced by the method of claim 7.

28. A metallic coated fabric, having a glossy shine, produced by the method of claim 11.

29. A metallic coated fabric, having a glossy shine, produced by the method of claim 14.

30. A metallic coated fabric, having a glossy shine, produced by the method of claim 18.

* * * * *